US005819478A

United States Patent [19]

Bayes

[11] Patent Number: 5,819,478

[45] Date of Patent: Oct. 13, 1998

[54] DAMP-PROOF COURSE MEMBER

[75] Inventor: Ronald Curtis Bayes, Much Hadham, United Kingdom

[73] Assignee: D. Anderson and Son Limited, Manchester, United Kingdom

[21] Appl. No.: 395,760

[22] Filed: Feb. 28, 1995

[30] Foreign Application Priority Data

Mar. 14, 1994 [GB] United Kingdom ..... 9404906
Oct. 14, 1994 [GB] United Kingdom ..... 9420819

[51] Int. Cl.[6] ..... E04B 1/64

[52] U.S. Cl. ..... 52/62; 52/379; 52/383; 52/412

[58] Field of Search ..... 52/378, 379, 383, 52/412, 459, 712, 715, 62

[56] References Cited

U.S. PATENT DOCUMENTS 4,218,856 8/1980 Irwin ..... 52/715 X
5,349,792 9/1994 Bayes .
5,437,132 8/1995 Meyers ..... 52/715 X

FOREIGN PATENT DOCUMENTS 2 143 874 2/1985 United Kingdom .
2 189 275 10/1987 United Kingdom .
2 197 889 6/1988 United Kingdom .
2 239 465 7/1991 United Kingdom .
2 267 518 12/1993 United Kingdom .

*Primary Examiner*—Carl D. Friedman
*Assistant Examiner*—Timothy B. Kang
*Attorney, Agent, or Firm*—Flynn, Thiel, Boutell & Tanis, P.C.

[57] ABSTRACT

The invention relates to a bitumenised P.V.C. member for incorporation in a cavity wall, including two flanges and a bridging portion, the bridging portion in use spanning the cavity and the flanges being incorporated in respective skins of the cavity wall. The bridging member is prevented from sagging by a support mechanism, in a preferred embodiment a polystyrene block of wedge shape, which abuts the inner skin of the wall.

8 Claims, 7 Drawing Sheets

DAMP-PROOF COURSE MEMBER

The invention relates to a member for incorporation in a cavity wall, and particularly to members used for joining cavity trays and damp-proof courses in cavity walls.

Such members are used to join lengths of damp-proof course (DPC) in cavity walls, and generally consist of a surface upon which the ends of adjacent lengths of DPC are mounted and fixed together, extending across the cavity from one skin to the other usually at an inclined angle. Members of this kind suffer from the disadvantage that pressure applied to the ends of the DPC, and thereby to the member, causes it to sag, forming uneven bonding and preventing formation of a water-proof seal.

Attempts to overcome this problem have up to now resulted in members provided with supports, such as for example are described in GB 2 143 874A. This document describes a member formed on site by snapping or creasing a length of a relatively rigid material such as wood or plastic, and placing it across the cavity. This support method is time consuming, and requires the use of additional materials. In addition, it is not always possible to form supports accurately under working conditions, especially as cavities in cavity walls often vary in width along the length of the wall. Inaccuracies in wall construction and in member construction result in variations in the angle of slope of members, along the length of a wall, which in turn results in twisting of the DPC, and prevents formation of water-proof joints.

It is an object of the invention to seek to mitigate disadvantages such as these.

Thus, according to one aspect of the invention there is provided a member for incorporation in a cavity wall, comprising a bridging portion for bridging a cavity in a cavity wall, a flange adapted to be received in a first skin of said cavity wall, and support means associated with the bridging portion and adapted to abut a second skin of said wall whereby to support the bridging portion in the cavity.

The support means may comprise a wing extending at substantially 90° from the bridging portion, and the wing may extend from a plate member, planar with said bridging portion, and the wing may be substantially triangular, and may preferably comprise a substantially right-angled triangle.

It is further preferred that there are a plurality of wings.

A support means may comprise a separate support member in the form of a block of substantially rigid material disposed in use, adjacent to the underside of the bridging portion of the member by flexible securing means, to provide support to the member when pressure is applied thereto.

The support means may conveniently be formed from a lightweight and relatively rigid material such as, for example, polystyrene. It may also be conveniently formed in a shape which corresponds to the gap left between the member and a skin of the cavity wall. The support member may therefore preferably be substantially triangular in end elevation, that is, of wedge configuration.

The flexible securing means is preferably adapted to allow movement between the bridging portion, and the support means. Thus, the support means may be held securely in place to perform its supporting function, whilst allowing movement in the cavity wall due to for example, settling or expansion, to be accommodated.

The securing means may be an adhesive. Alternatively the securing means could be a joint formed by cooperating parts of the support means and bridging portion, such as a tongue and groove joint, it being required that the cooperating parts fit together in a loose engagement to provide the required flexibility.

Where an adhesive is employed, it may be provided with a release means such as release paper, which would be removed when the support means is to be fixed in place.

The member may preferably be formed from a flexible, foldable weldable material such as bitumenised P.V.C., and may further include a first locating flange extending from its bridging portion at substantially 90° thereto and substantially horizontally in use in the manner of a shelf or ledge upon which the support means may be mounted by way of the securing means as described above. This may be in addition to, or as an alternative to the securing means provided on the bridging portion. The locating flange may be moulded integrally with the bridging portion, or may be fixed thereto during manufacture by welding, gluing, stapling and any other suitable method.

The member may be provided with a second locating flange, extending from the bridging portion at substantially 90° thereto and substantially vertically in use. This further locating flange helps to reduce ingress of water. This flange may also be fixed as set out above in relation to the first locating flange, for ease of manufacture.

In an alternative embodiment, both locating flanges may be formed integrally from a single planar part, each flange being a section of the said planar part defined by a crease or fold line, or weld line by which the said part is attached to the member.

The member may be provided with a third locating flange, which extends from the member substantially downwardly in use adjacent a part of the support means to retain it, and prevent passage of water or moisture by capillary action from the outer to inner skin of a cavity wall in which the member is installed.

According to a second aspect of the invention there is provided a set of parts for providing a member for incorporation in a cavity wall comprising a member, a bridging portion of said member for bridging a cavity in the cavity wall and a support means adapted to be secured adjacent the bridging portion, whereby in the assembled set, the support means abuts an inner skin of the cavity wall.

It is preferred that the wings may comprise flanges for connection therebetween, and that the member may be formed from a foldable, weldable material, such as bitumenised P.V.C.

The member may further be provided with an edge-piece extending at substantially 90° from the bridging portion and a said flange, and connecting the two.

The member may comprise a plurality of flanges adapted to be received in a first skin of a cavity wall, and the flanges may be located at opposite ends of the bridging portion.

There may also be provided a locating member for holding the member in place while bonding to a cavity tray or damp-proof course, which may be in the form of a clip or strip.

Members embodying the invention are hereinafter described, by way of example, with reference to the accompanying drawings.

Figure 1:
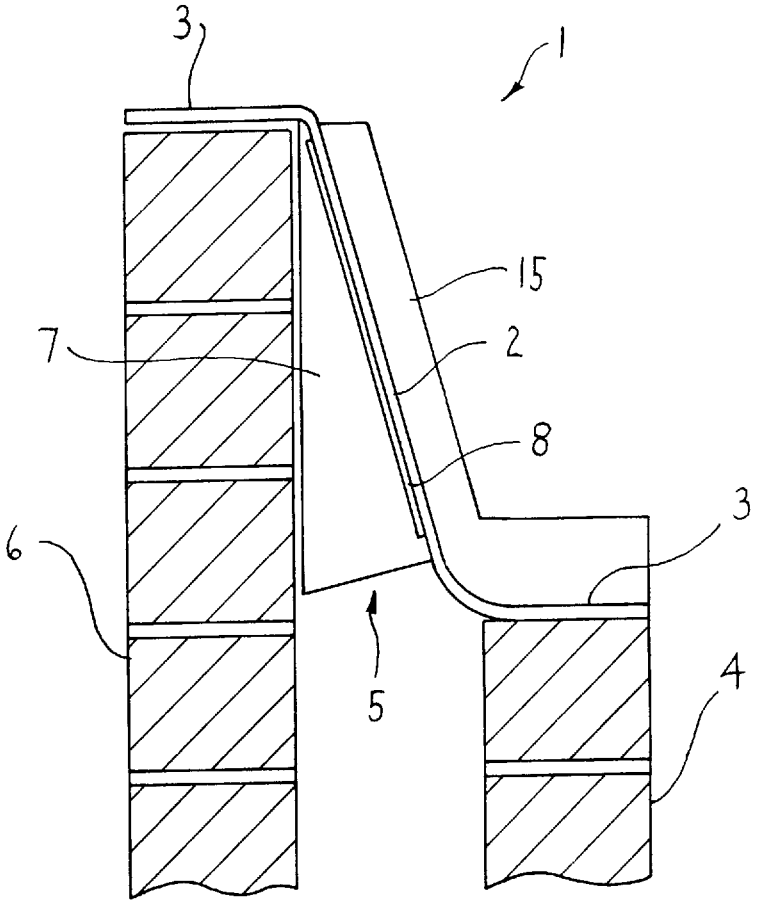
FIG. 1 is a transverse section through a cavity wall bearing one embodiment of a member according to the invention.

Referring firstly to FIGS. 1 to 5 of the drawings there is provided a member 1 for incorporation in a cavity wall, comprising a bridging portion 2 for bridging the cavity in the cavity wall, and a flange 3 adapted to be received between two courses of a first (outer) skin 4 of said wall, the bridging portion 2 comprising support means 5, adapted to abut with a second (inner) skin 6 of said wall.

The bridging portion 2 may be a planar member, and may be constructed from a flexible material which may be substantially waterproof. An example of a suitable material is bitumenised P.V.C. One or more flanges 3 extend from the bridging portion. The support means 5 may be a planar member which may for example include extensions of the bridging portion 2 (see FIG. 1).

In the illustrated embodiment the member 1 has two flanges 3, located one at the top (as viewed) and one at the bottom (as viewed) of the bridging portion 2. The flange or flanges 3 are adapted to be received between two courses of bricks of the respective skins 4, 6 of the cavity wall in which the member 1 is located, and for this reason they are substantially flat. However, other configurations of the flanges 3 are envisaged, for example each end of the member 1 may be provided with more than one flange 3, and each flange 3 may be any suitable shape providing it is capable of being received as stated above.

The support means 5 may take the form of a protuberance, or "wing" 7 extending from the under side (in use) of the bridging portion 2. It will be apparent that the wing 7 serves to prevent collapse of the bridging portion 2, by abutting against the skin 6 of the cavity wall, and it will further be apparent that a variety of shapes of wing 7 may be employed. In the embodiment illustrated here, the wing 7 is shown as a planar triangle.

Figure 2:
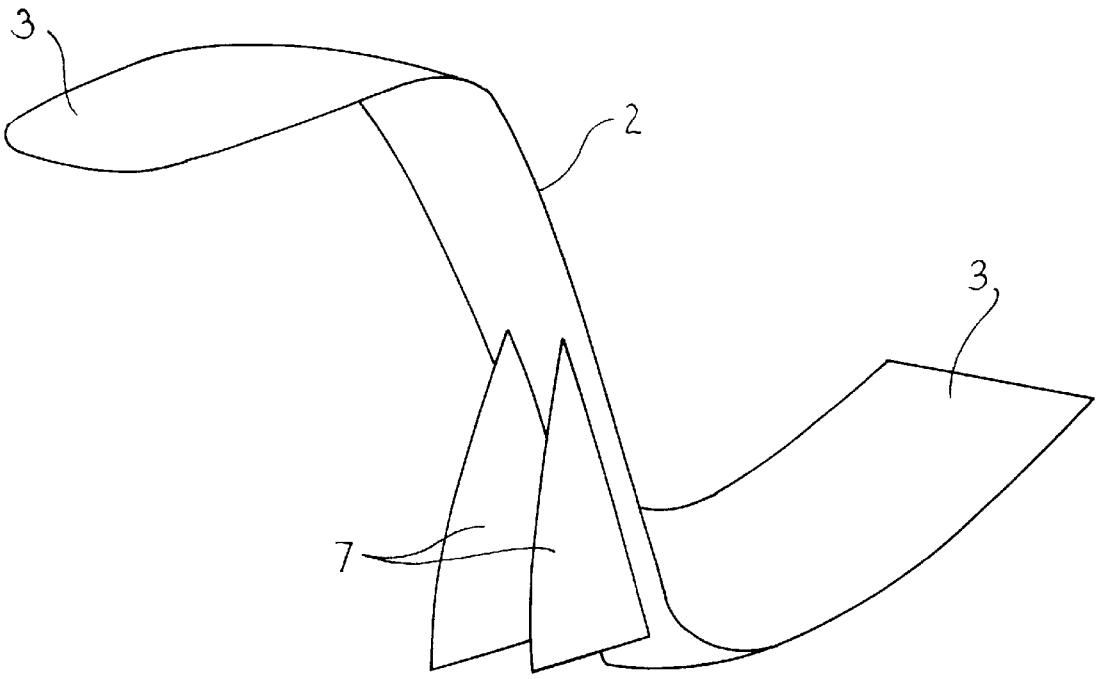
FIG. 2 is a perspective view of the member embodying of FIG. 1.
Figure 3:
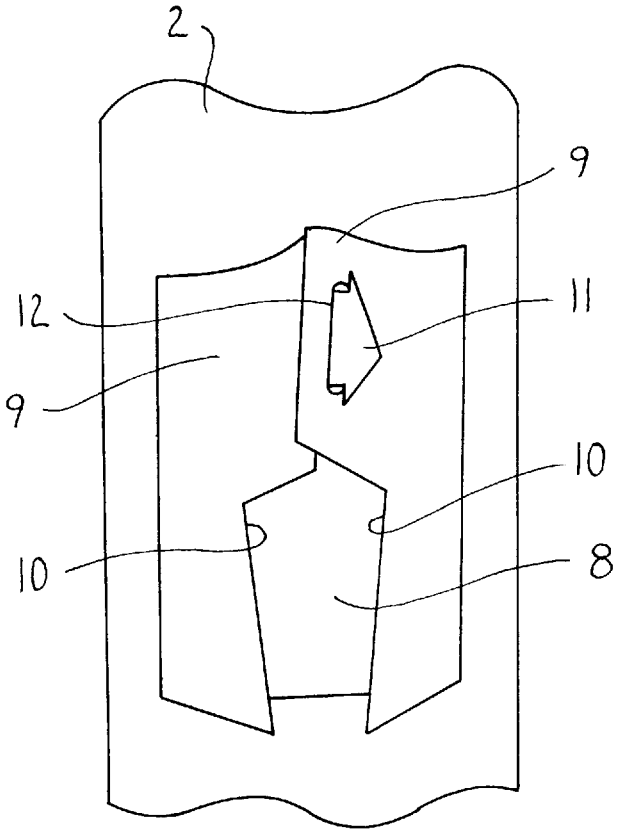
FIG. 3 is a rear elevational view of a part of a second embodiment of the member according to the invention showing a support means thereof.

There may be a plurality of wings 7 as shown a suitable configuration comprising two wings 7, spaced apart from one another and extending substantially parallel to one another (FIG. 2).

The or each wing 7 may be formed integrally with the bridging portion 2, or may be formed separately and fixed in place by for example welding or gluing. There may also be a plate member 8 fixed to the underside (in use) of the bridging portion 2, and which provides additional support to the bridging portion 2.

Figure 4:
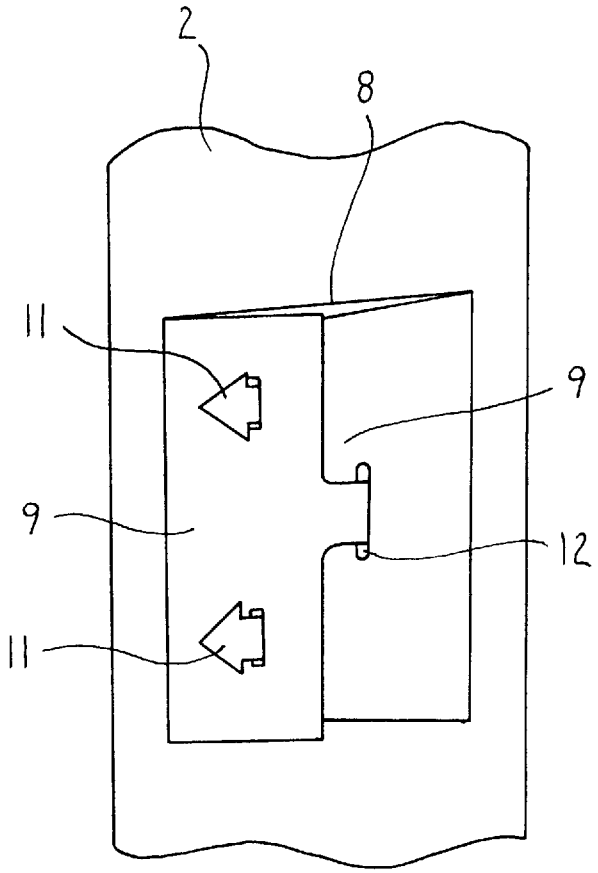
FIG. 4 is rear perspective view of a further support means suitable for use in a member according to the invention.

When two or more wings 7 are provided, they may include flanges 9, which may be used to cross-connect the wings 7 for added strength. The flanges 9 may extend from the outer (in use) edges 10 of the wings 7 and at substantially 90° thereto, and may in addition be provided with a cooperating tongue 11 and slit 12, to form a strong enclosure when the tongue is inserted through the slit 12, the tongue having an arrow-shaped head which has lateral shoulders for locating behind the material of the wing 7 containing the slit, whereby to lock the wings together. FIG. 4 shows an alternative with three tongues 11 and slits 12.

The support means 5 may be provided with a separate member as a strengthening member which may comprise a block made of polystyrene or wood or other suitable material. The strengthening member may be adapted to be fitted into the support means 5. When the support means 5 comprises an enclosure as described, the strengthening member may be adapted to fit inside.

In use, the member 1 is positioned to bridge the cavity of a cavity wall, either at the end of a cavity tray or damp-proof-course (DPC) or at a join between two runs of DPC. When the member 1 is for use at the end of a run of DPC, it may be provided additionally with an edge piece 15, extending upwardly (in use) from the bridging portion 2 and flange 3, as illustrated in FIG. 1. The edge piece 15 acts to prevent trapped moisture from running down the brickwork at the edge of the DPC.

To be most effective it is desirable that the member 1 be positioned in the cavity so that the bridging portion 2 slopes from one side to the other. This is most easily achieved by mounting the flange 3 in between courses of one of the skins (the outer one in use), and positioning the member 1 with the bridging portion 2 sloping upwards, to either abut against the other (the inner as considered in use) skin, or be received between two courses of it at a higher position. In either position, the bridging portion 2 is supported by the support means 5 which abuts with its free rear (in use) edge and the forward face of the inner skin 6 of the wall.

Figure 5:
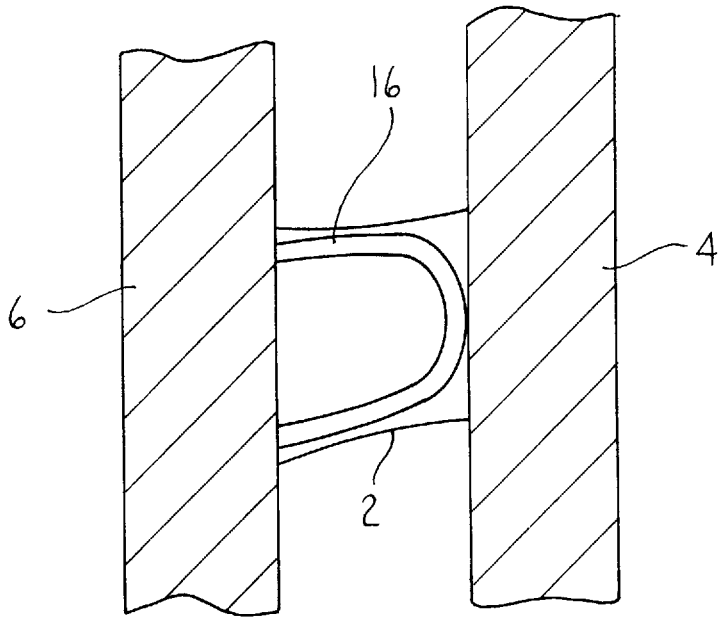
FIG. 5 is an under plan view of a member according to the invention including a deformable locator.

There may further be provided a deformable locator 16, placed on the underside of the member 1, as shown in FIG. 5. This may take the form of a clip or strip, and serves to aid location of the member 1 in the cavity.

Figure 6:
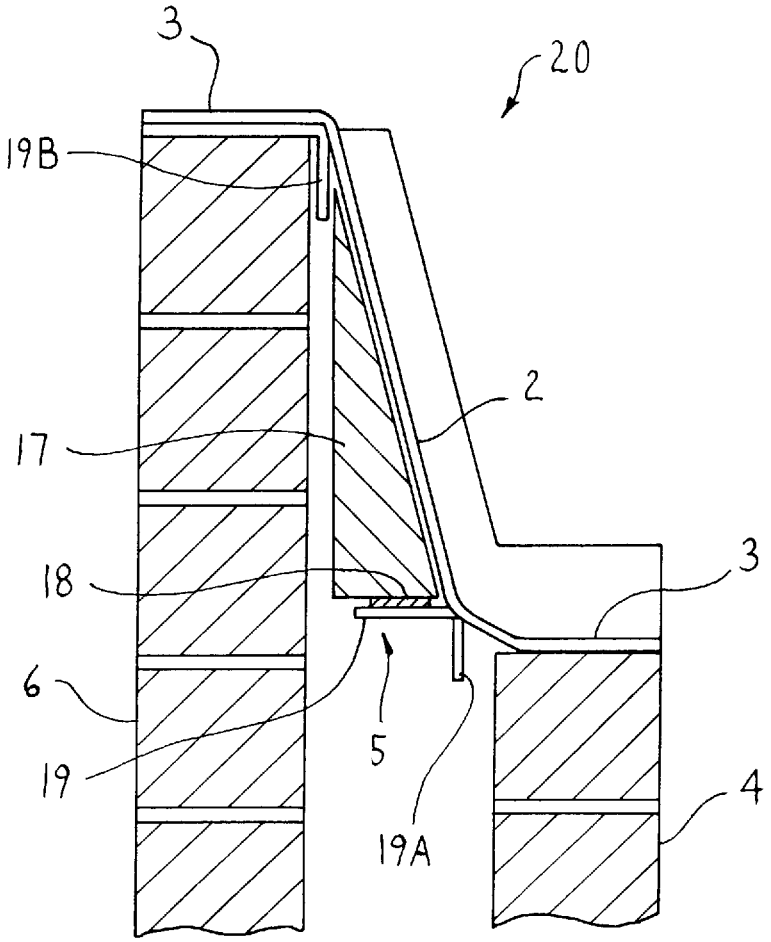
FIG. 6 shows a further embodiment of the member according to the invention.
Figure 7:
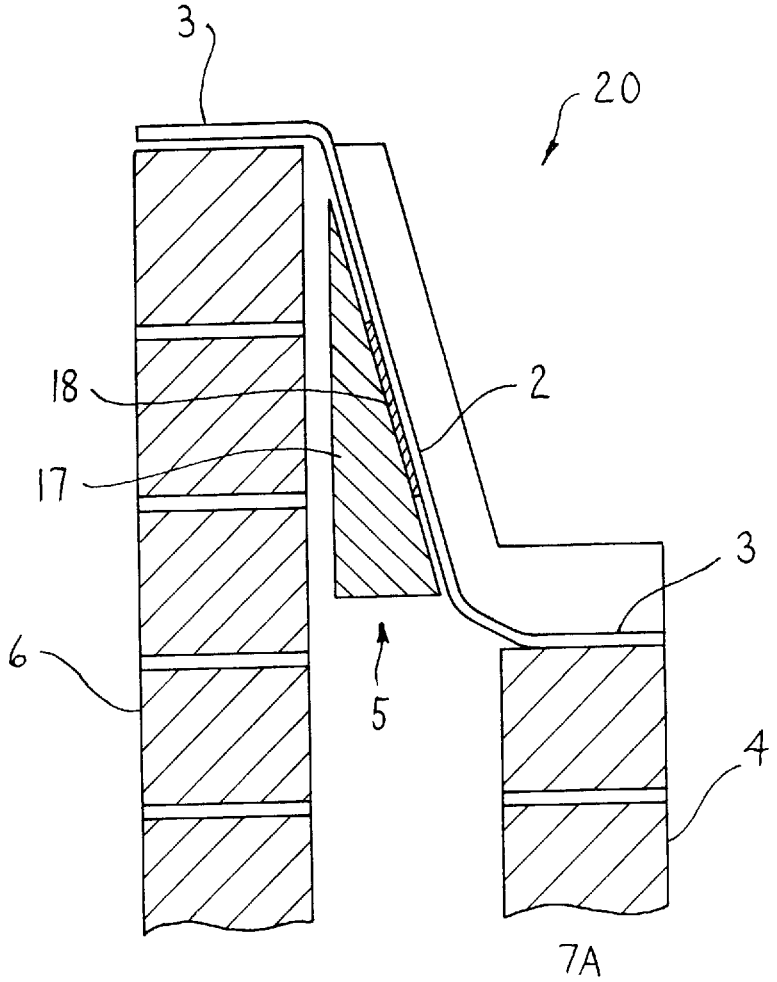
FIG. 7 shows a yet further embodiment of the member according to the invention.

Referring now to FIGS. 6 and 7 in which like parts have like numerals in FIGS. 1 to 5, there is shown a member 20 having support means 5, the support means 5 comprising a block of substantially rigid material 17 disposed in use, adjacent to the underside of the bridging portion 2 of the member 1 by flexible securing means 18, to provide support to the member 20 when pressure is applied thereto.

Referring particularly to FIG. 6, member 20 is illustrated which is provided with three locating flanges, 19, 19A, and 19B. The first locating flange 19 extends from the bridging portion 2 at substantially 90° thereto and substantially horizontally in use in the manner of a shelf or ledge upon which the support means 5 may be mounted by way of the securing means 18. A second locating flange 19A extends substantially downwardly from the bridging portion 2, and a third locating flange 19B also extends substantially downwardly from a point near the top (in use) of the bridging portion 2. The support means 5 in the form of a wedge-shaped polystyrene block 17 is located between the first and third locating flanges 19, 19B. The block 17 is held in place by the flexible securing means 18, which in the illustrated embodiment is a patch of flexible adhesive located between the block 17 and the first locating flange 19 and which may be exposed for use by removing a release paper.

The member 20 illustrated in FIG. 7 is closely similar to that of FIG. 1, except that there are no locating flanges required, the block 17 being secured to the underside of the bridging portion 2 in this embodiment by flexible securing means 18 in the form of a flexible adhesive, as in FIG. 6.

In use the member 20 of FIG. 6 or FIG. 7 may be assembled prior to insertion between the skins 4, 6 of the wall, by fixing the support means 17 in place as described. The member 20 is then located in the wall as shown with the flanges 3 being received between two courses of either one, or as illustrated both, skins 4, 6 of the cavity wall. Alternatively, the member 20 may be located in position in the wall first as described, and the support means may then be secured to the bridging portion 2.

Thus, the member 20 can be used where there is a requirement for a member which can provide support for cavity trays and damp-proof courses, whilst retaining flexibility to accommodate movement in the surrounding brickwork. The water-excluding abilities of the member 20 are also enhanced particularly by the flange 19A which acts as a shield in deflecting water passing through the outer skin of the wall downwardly into the cavity, and thus away from the inner skin. The flange 19A thus acts as a drip lip, likewise the flange 19B acts as a drip or shield or stop deflecting any water passing up the bridging portion 2.

The securing means 18 between the base of the block 17 and the flange 19 may comprise a mechanical fixing means, such as a screw, staple or rivet.

Sections of DPC at a joint may be joined using a glue applied to the bridging portion 2 of the member 1 or 2, or alternatively, the bridging portion 2 may be supplied with an adhesive pad, with a covering which may be removed when it is desired to be used.

The invention thus allows DPCs to be joined easily by providing a strong platform upon which pressure can be applied for bonding. The configuration of the member 1 allows it to be used to bridge cavities in cavity walls of varying width, where the wall has been poorly made, and also one size of member 1 may be used to bridge a range of cavity widths. Thus, for example, when a site manager is ordering members 1 for a building project, one size of member 1 can be selected for use without needing to know the precise widths of cavities in the project. Also, variations in width within a range can be accommodated. This accommodation is facilitated by the curves of the member 1 and the positioning and the support, allowing a standard angle of slope to be maintained, even when a cavity varies in width along its length.

Thus it can be seen that a member embodying the invention as hereinbefore described with reference to the drawings is easy to manufacture and use, and is capable of accommodating variations in cavity width whilst maintaining a standard angle of slope, due to the configuration of its support. No fabrication is required on site.

I claim:

1. A member for incorporation in a cavity wall, comprising: a bridging portion for bridging a cavity in a cavity wall, a flange extending from said bridging portion and adapted to be received in a first skin of the cavity wall, a support member associated with said bridging portion and adapted in use to abut a second skin of said wall to support said bridging portion against downward movement thereof in the cavity, and locating flanges adjacent said bridging portion, one said locating flange being secured to the support member by a securing means.

2. A member as defined in claim 1, wherein one of said locating flanges comprises a shield adapted to deflect water passing through the outer skin of the wall downwardly into the cavity.

3. A member for incorporation in a cavity wall, comprising: a bridging portion for bridging a cavity in a cavity wall, a flange extending from said bridging portion and adapted to be received in a first skin of the cavity wall, and a plurality of wings extending from said bridging portion and being adapted to abut a second skin of the cavity wall to support said bridging portion in the cavity, said wings extend at substantially 90° from said bridging portion, said wings being shaped substantially as a right-angled triangle, said wings each having a wing flange, and said wing flanges including interconnection means for connecting said wings together.

4. A member for incorporation in a cavity wall, comprising: a bridging portion for bridging a cavity in a cavity wall, a flange extending from said bridging portion and adapted to be received in a first skin of the cavity wall, support means associated with said bridging portion and adapted in use to abut a second skin of the cavity wall, and an edge-piece extending at substantially 90° from said bridging portion and said flange and connecting said bridging portion and said flange.

5. A member for incorporation in a cavity wall, comprising: a bridging portion for bridging a cavity in a cavity wall, a flange extending from said bridging portion and adapted to be received in a first skin of the cavity wall, support means associated with said bridging portion and adapted in use to abut a second skin of the cavity wall, and a locating member placed on said bridging portion.

6. A member as defined in claim 5, wherein the locating member comprises a clip.

7. An apparatus for bridging a cavity defined between a first skin of a cavity wall and a second skin of the cavity wall, with the first skin being spaced apart from the second skin, comprising:

a bridging portion being adapted in use to extend between the first skin and the second skin;

a first skin flange connected to said bridging portion, said first skin flange being adapted in use to be received within the first skin;

a locating flange connected to said bridging portion; and a support positioned adjacent to the bridging portion and secured to the locating flange.

8. The apparatus of claim 7, further comprising a second skin flange connected to said bridging portion, said second skin flange being adapted in use to be received within the second skin.

* * * * *